US005476222A

United States Patent [19]

Singer et al.

[11] Patent Number: 5,476,222

[45] Date of Patent: Dec. 19, 1995

[54] METAL SPRAYING APPARATUS

[75] Inventors: Alfred R. E. Singer; Walter N. Jenkins, both of Wales, United Kingdom

[73] Assignee: Sprayforming Developments Limited, Swansea, United Kingdom

[21] Appl. No.: 167,889

[22] PCT Filed: Jun. 22, 1992

[86] PCT No.: PCT/GB92/01128

§ 371 Date: May 2, 1994

§ 102(e) Date: May 2, 1994

[87] PCT Pub. No.: WO93/00170

PCT Pub. Date: Jan. 7, 1993

[30] Foreign Application Priority Data

Jun. 20, 1991 [GB] United Kingdom ..... 9113304

[51] Int. Cl.[6] ..... B05B 7/08; B05B 7/16; C23C 4/12; B22F 9/08

[52] U.S. Cl. ..... 239/99

[58] Field of Search ..... 118/63; 239/295, 239/300, 301, 581.1, 11, 99, 13, 296, 297, 543, 410, 543; 137/624.13, 625.15, 625.16; 222/603

[56] References Cited

U.S. PATENT DOCUMENTS

| | | | |
|---|---|---|---|
| 3,937,252 | 2/1976 | Ishida | 137/624.13 |
| 3,941,154 | 2/1976 | Bishop | 137/624.13 |
| 4,060,117 | 1/1972 | Clark et al. | 239/296 X |
| 4,064,295 | 12/1977 | Singer | 427/424 |
| 4,508,620 | 4/1985 | Najima et al. | 137/624.13 |

FOREIGN PATENT DOCUMENTS

| | | | |
|---|---|---|---|
| 127303 | 12/1984 | European Pat. Off. . | |
| 356944 | 9/1930 | United Kingdom | 137/624.13 |
| 90/04661 | 5/1990 | WIPO . | |
| 91/12088 | 8/1991 | WIPO . | |

*Primary Examiner*—Andres Kashnikow
*Assistant Examiner*—Kevin Weldon
*Attorney, Agent, or Firm*—Cooper & Dunham

[57] ABSTRACT

A stream of molten metal particles in a metal spraying apparatus is deflected from side to side by gas issuing from two nozzle blocks disposed at diametrically opposite sides of the stream. Gas is supplied to the two nozzle blocks (13) alternately under the control of a rotary valve (19) having a stator (18) and a cylindrical rotor (24). The rotor has two circumferentially extending grooves (26) whose cross-sectional area varies in predetermined manner and each of which serves to provide and cut off communication between an inlet port (21) for gas under pressure and an outlet port (23) which is circumferentially aligned with the inlet port and which leads to an associated one of the nozzle blocks. The areas of the inlet and outlet ports are each greater than the maximum cross-sectional area of the groove, so that the quantity of gas reaching the nozzles at each instant is determined by the instantaneous effective area of the groove (26). The limiting quantity of gas emitted from the nozzles corresponding to maximum deflection of the metal particle spray is however determined by the total area of the nozzles in the block. An increase in the quantity of gas issuing from the nozzles increases the deflection of the metal particle stream.

8 Claims, 5 Drawing Sheets

METAL SPRAYING APPARATUS

BACKGROUND OF THE INVENTION

1. Field of the Invention

This invention relates to metal spraying apparatus and is concerned with apparatus for spraying a coating of metal particles on to the surface of a workpiece.

2. Description of the Prior Art

U.S. Pat. No. 4,064,295 to Alfred R. E. Singer discusses a stream of gas atomized particles that moves past a secondary gas stream towards a substrate. The secondary stream is directed in an oscillatory manner against the stream of atomized particles to deflect the latter such that the particles are distributed in a controlled manner over the surface of the substrate.

SUMMARY OF THE INVENTION

According to the invention there is provided metal spraying apparatus comprising means for producing a stream of molten metal particles, a plurality of sets of gas nozzles arranged to direct a flow of gas at said stream in a direction inclined at an acute angle to the axis of said stream to deflect the flow laterally, and valve means for controlling cyclically the timing and quantity of gas supplied to the gas nozzles to cause the particle flow to move cyclically to and fro laterally, said sets of gas nozzles including two sets disposed at diametrically opposite sides respectively of the axis of the particle stream, and said valve means being arranged to control the supply of gas under pressure to the nozzles of the said two sets, characterized in that the valve means supplies gas to the two sets of nozzles through respective flow passages the effective cross-sectional area of each of which varies between zero and a maximum.

According to a preferred feature of the invention the effective cross-sectional area of the flow passage to each of the two sets in turn increases from zero to said maximum and decreases back to zero, the said area of each flow passage commencing to increase after the said area of the other flow passage has decreased to zero.

In one construction according to the invention, the valve means comprises a cylindrical rotor mounted for rotation in a cylindrical bore in a stator, the rotor having for each set of nozzles a circumferentially extending groove the radial cross-sectional area of which varies in a predetermined manner, and the stator element having inlet ports connected to be supplied with gas and outlet ports circumferentially aligned with the inlet ports respectively, the inlet and the respective aligned outlet ports being aligned with the respective grooves in said rotor whereby gas flows from each inlet port to the associated outlet port by way of one of the circumferentially extending grooves in the rotor. Conveniently, the cross-sectional area of said circumferentially extending groove varies stepwise.

In another construction according to the invention, the valve means comprises a hollow cylinder rotor mounted for rotation in a cylindrical bore in a stator, the interior of the rotor being connected to be supplied with gas, and the rotor having for each set of nozzles a circumferentially extending slot the axial width of which varies in a predetermined manner, and the stator having for each set of nozzles an outlet port communicating with the set of nozzles and being axially aligned with the slot associated with the same set of nozzles, each outlet port having an axial width equal to or greater than the widest part of the slot.

The total area of each set of nozzles may be equal to or less than the maximum effective area of the outlet port supplying gas to the set of nozzles, whereby the nozzles impose a limit on maximum flow of gas therethrough for a given gas supply pressure.

The apparatus may further comprise an accumulator chamber in permanently open communication with the respective ducts conveying the gas supply from the valve means to the sets of gas nozzles. Preferably the volume of said accumulator chamber is adjustable. The provision of the accumulator chamber has a substantial smoothing effect on the changes in the volume of air delivered to the nozzles corresponding to changes in the dimensions of the grooves in the rotor. By continuously monitoring the variation in thickness of the coating of sprayed metal across the width of the workpiece, the said volume can be adjusted to achieve the most even distribution of the sprayed metal.

BRIEF DESCRIPTION OF THE DRAWINGS

The invention will now be described in more detail with reference by way of example to the accompanying diagrammatic drawings in which.

DETAILED DESCRIPTION OF THE PREFERRED EMBODIMENTS

Figure 1:
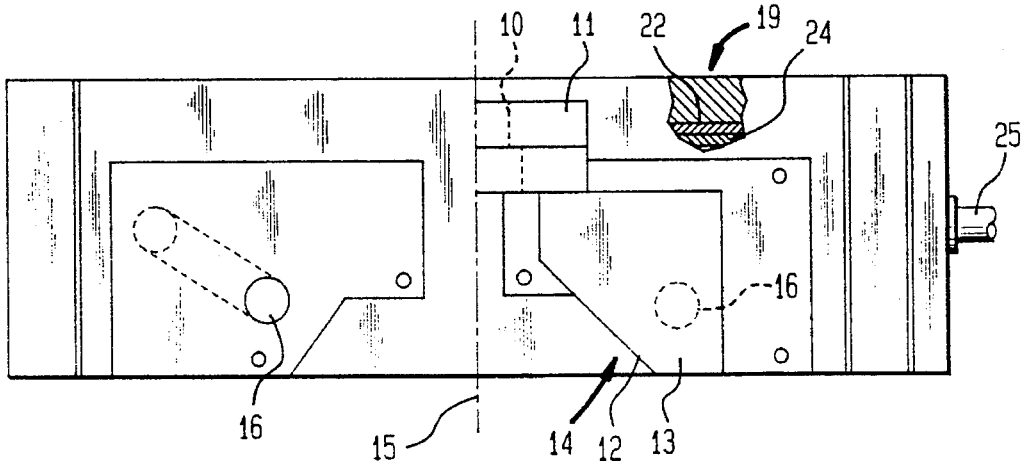
FIG. 1 is a compound front view of part of an apparatus according to the invention, on the line 1—1 of FIG. 2.
Figure 2:
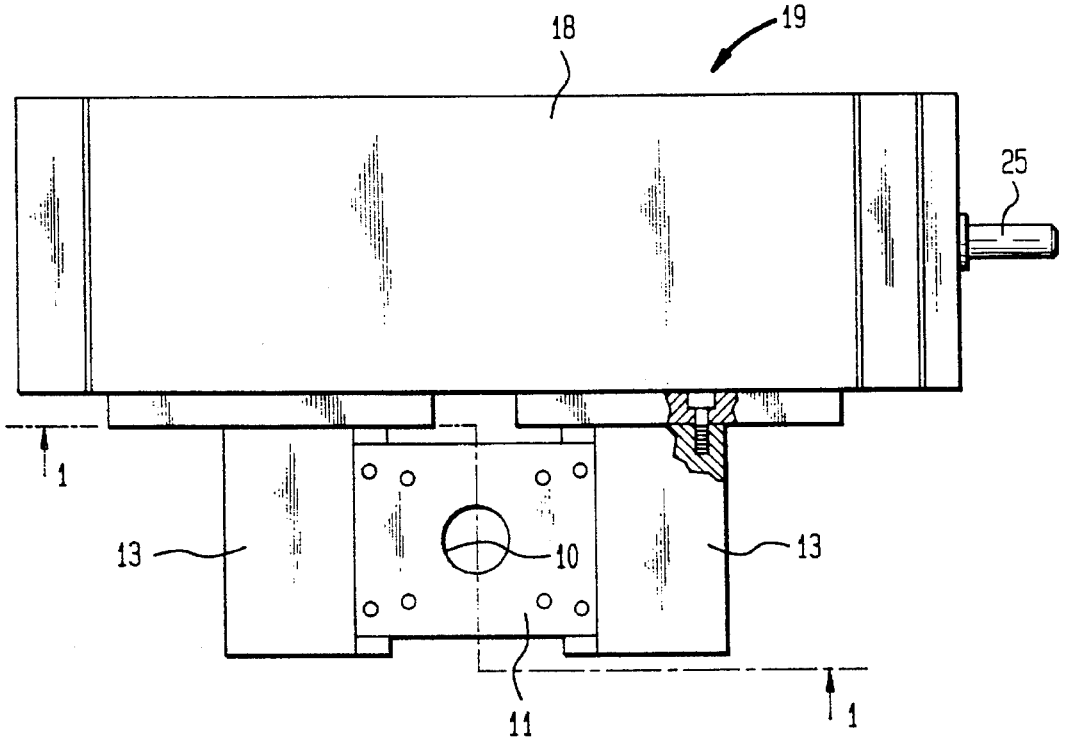
FIG. 2 is a plan of the apparatus of FIG. 1.
Figure 3:
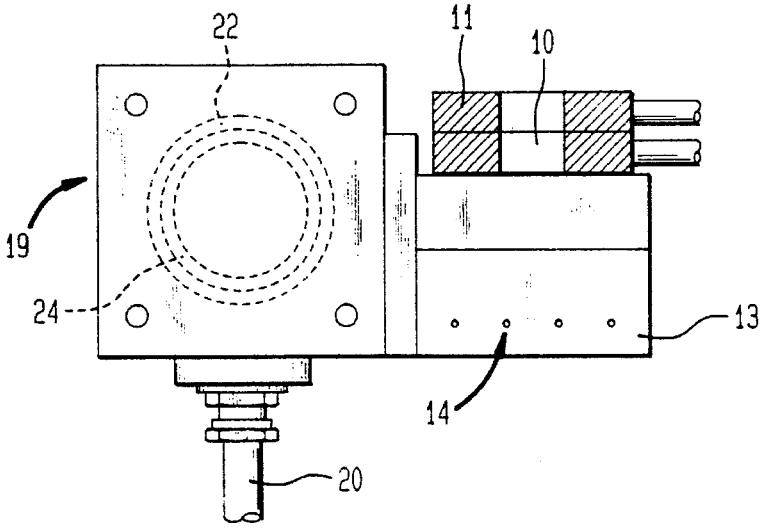
FIG. 3 is a partial sectional side view of the apparatus of FIG. 1.

Referring first to FIGS. 1 to 3, the apparatus is designed to cause a vertically descending stream of particles of molten metal to be deflected laterally to and fro cyclically to apply a uniform coating of metal particles to a workpiece passed beneath the apparatus. A steady stream of molten metal is poured, for example, from a crucible (not shown) through a hole 10 in an atomizer 11. In an annular rebate formed in the underside of the atomizer about the hole 10 a hollow manifold ring (not shown) is mounted in which is formed a ring of gas nozzles. The nozzles are angled downward and inward towards the stream of molten metal and gas under pressure supplied to the manifold ring and causes the resulting jets of gas from the nozzles to break the stream of metal up into particles which continue to fall substantially vertically in a stream.

The stream of particles falls between two horizontally spaced nozzle blocks 13 which are bridged by the atomizer and on which the atomizer 11 is mounted. The nozzle blocks 13 are respectively formed with downwardly inclined faces 12 in which sets of gas nozzles (indicated generally at 14) are formed. The faces 12 are inclined downward at 45° to the horizontal and the nozzles of the two sets are arranged in horizontal lines in these faces, and are angled to converge on a predetermined point on the axis 15 of the particle stream. The nozzles in each block open from a manifold passage 16 in the block.

The two nozzle blocks 13 are mounted on the front face of the stator 18 of a rotary valve 19, and the manifold passages 16 communicate with respective gas outlet ports of the stator.

Gas under pressure from a suitable source is fed to two inlet pipes 20 connected to unions in the bottom face of the stator. The unions communicate with two inlet ports 21 formed in a cylindrical sleeve 22 (see also FIG. 4) mounted in the bore of the stator. The sleeve 22 is formed with two outlet ports 23 respectively circumferentially aligned with the two inlet ports 21 and in permanently open communication with the two manifold passages 16 respectively. A cylindrical valve rotor 24 is rotatably mounted in the sleeve and is driven by an air motor (not shown) through a shaft 25. The rotor is formed with two circumferentially-extending surface grooves 26 which are respectively circumferentially aligned with the two sets of inlet and outlet ports 21, 23. Each of the two grooves is of varying width and/or depth along its length to provide a varying cross-sectional area for flow circumferentially of the rotor along the grooves. The two grooves are the same as each other in this instance but are 180° out of phase with each other. Thus as the rotor rotates, the grooves 26 respectively serve to place the two inlet ports 21 in intermittent and varying communication with the two outlet ports 23. The angular extent of each groove 26 is 180° while the angular separation between the associated inlet and outlet ports 21, 23 is only 90°, so that the minimum cross-section of the part of the groove 26 instantaneously placing ports 21, 23 in communication determines the flow in general. The fit between the co-operating cylindrical surfaces of the sleeve 22 and rotor 24 operates to form a seal against leakage from grooves 26.

Figure 4:
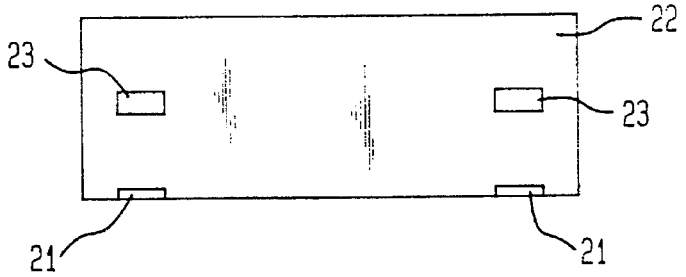
FIG. 4 shows a sleeve component of the apparatus.
Figure 5:
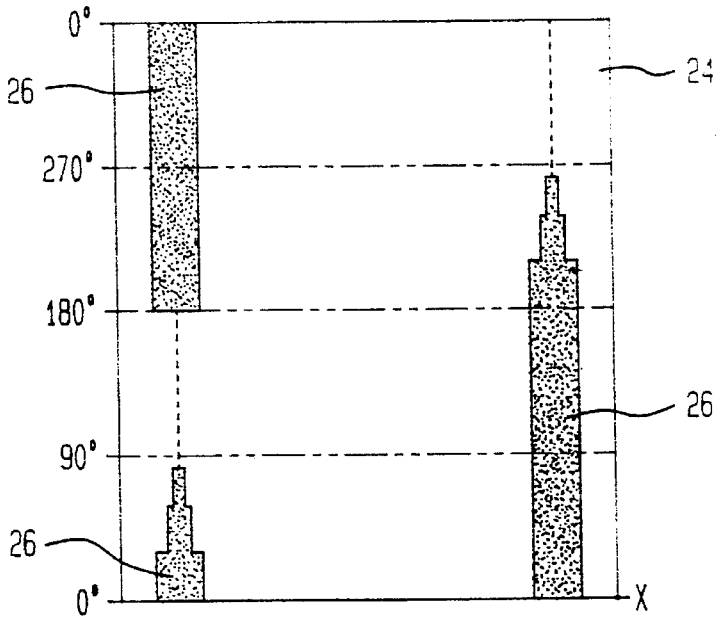
FIG. 5 is a developed view of porting in a rotor of the apparatus.
Figure 5A:
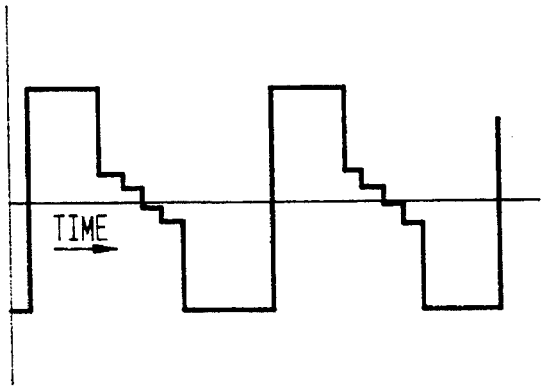
FIG. 5A illustrates the deflection pattern of the metal spray resulting from the porting arrangement of FIG. 5.

FIG. 4 shows the inlet and outlet ports 21, 23 in the sleeve 22. The two ports 21 and 23 of each pair are angularly spaced at 90° to each other about the axis of rotation of the rotor 24. The areas of ports 23 represent the maximum area of communication with the manifold passages 16, but the effective area is reduced or blanked off in certain rotational positions of the rotor. FIG. 5 is a developed view of the rotor 24 and shows the width of the circumferential grooves 26 varying stepwise. It will be understood that in the result, gas under pressure is supplied to the two manifold passages 16 alternately so that the gas jets from the nozzles cause the flow of metal particles to be deflected laterally cyclically to and fro across the width of the workpiece, the quantity of gas supplied to each set of nozzles 14 determining the deflection of the particle stream by the nozzles. The reduced area of the groove in communication with each set of nozzles is arranged at its trailing end, and after the end of the groove passes the associated port 21, 23 cutting off the gas flow through that port, gas flow commences to the other set of nozzles. The apparent circumferential overlap of the grooves in FIG. 5 is due to the fact that the inlet and outlet ports associated with each groove are at 90° to each other.

The areas of ports 21 and 23 are at least equal to and preferably greater than the maximum cross-sectional area of the associated groove 26, so that, except when deflection of the metal particle stream by gas from a set of nozzles 14 is a maximum, the minimum cross-sectional area of the section of groove 26 placing ports 21 and 23 in communication with each other at any instant determines the quantity of gas supplied to nozzles 14. However, when the deflection of the metal particle flow is a maximum, the nozzles 14 impose the limit on the gas flow.

The grooves 26 can be tapered instead of being stepped in cross-section but extremely complex analysis is required and a given form of groove may, even so, apply in only a particular set of operating conditions. The stepped form of the grooves 26 can, with careful design in relation to specified operating conditions, give a close approximation to an absolutely even distribution of the sprayed metal across the workpiece.

Figure 6:
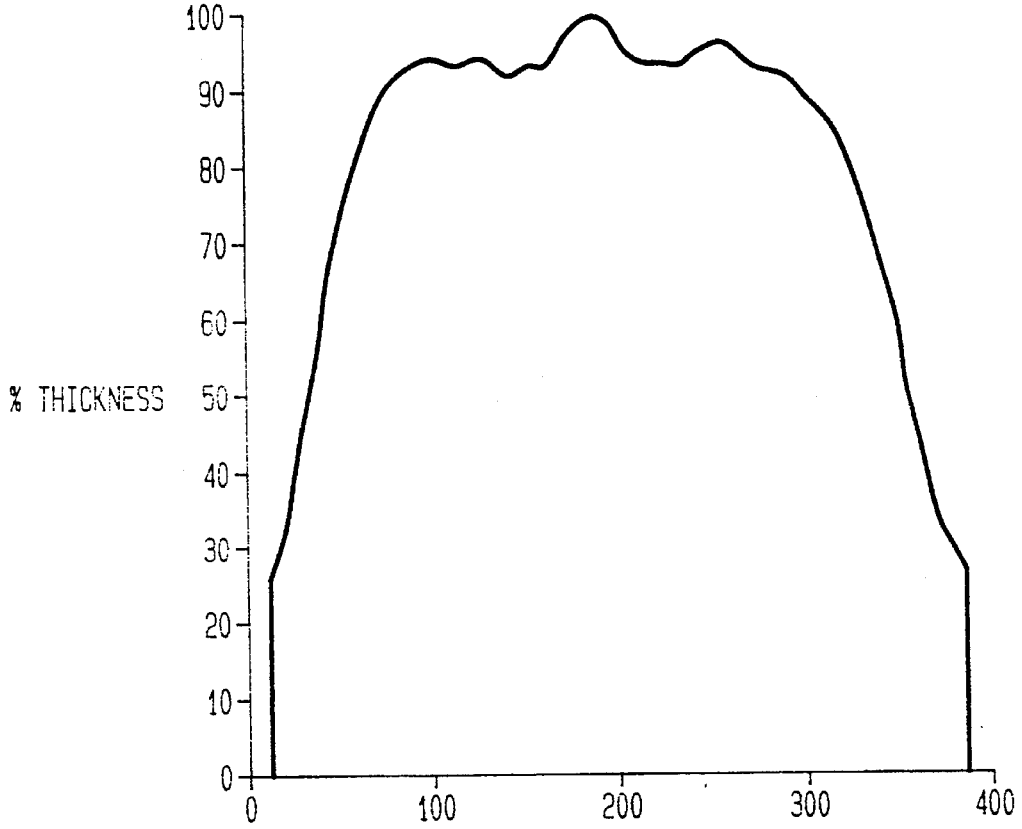
FIG. 6 is a diagrammatic graph of distribution of the sprayed metal.

The graph in FIG. 6 illustrates a typical distribution of the sprayed metal across the width of the workpiece, using the apparatus of FIGS. 1 to 5. The sprayed layer is somewhat thin adjacent the edges of the workpiece but the central area of the workpiece is well and reasonably evenly covered, with a variation of under 10% in the thickness of the coating.

Figure 8:
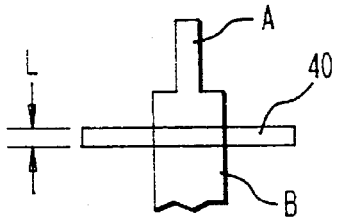
Figure 9A:
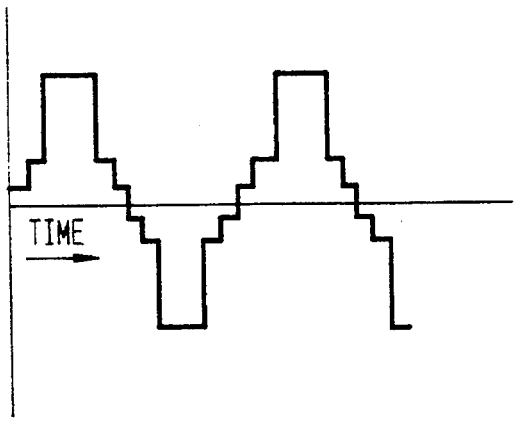
FIG. 9A shows the deflection pattern resulting from the arrangement of FIGS. 7 to 9.
Figure 7:
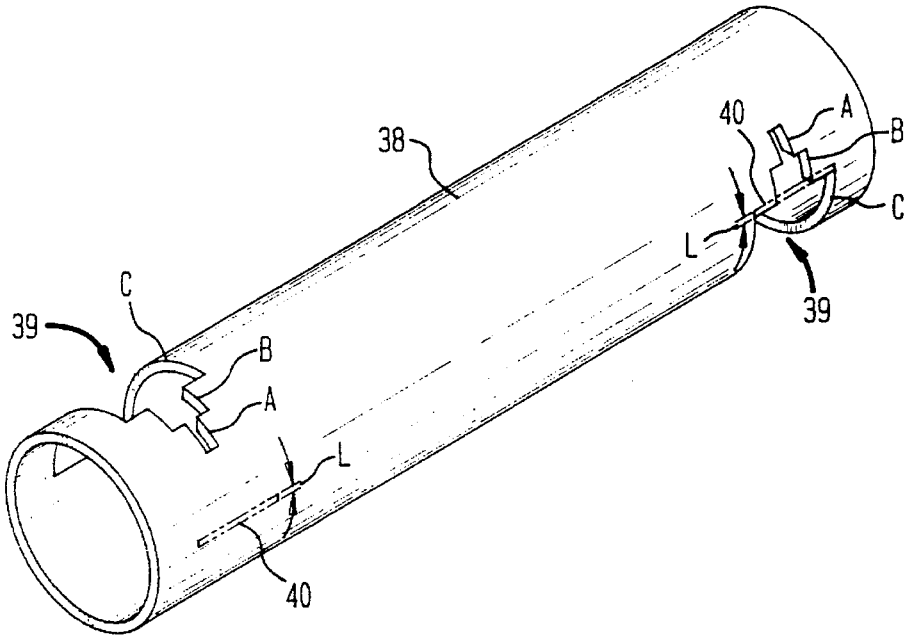
FIG. 7 illustrates an alternative form of the valve, FIG. 8 indicates the effective outlet area of the valve of FIG. 7.
Figure 9:
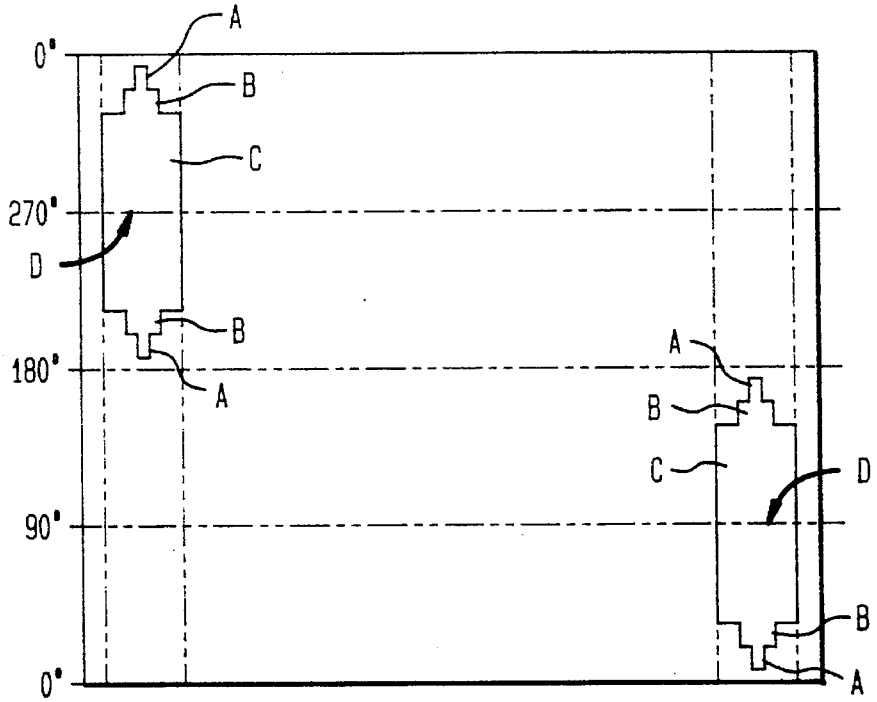
FIG. 9 shows a developed view of the valve slots.

Referring now to FIG. 7 of the drawings, an alternative form of rotary valve to replace valve 19 is illustrated diagrammatically. In this arrangement, the cylindrical rotor 38 is hollow and the gas is supplied to the interior of the rotor, and the valve apertures are in the form of circumferential slots 39 of varying axial length shown in FIG. 8. Each of the two outlet ports 40 in the stator is a rectangular slot which has a relatively small dimension L in a circumferential direction but has an axial length not less than the maximum axial length of the slot 39 in the rotor. At any instant therefore the effective area of the outlet port 40 is given by the circumferential dimension L of the slot in the stator multiplied by the axial length of the part of the slot in the rotor radially in register with the port, as shown in FIG. 9. In the example shown, each valve slot is of stepped form with a wide central portion C and progressively narrower end portions B and A, so that when portion B is in register with the outlet port the effective area of the port is the width of portion B x the circumferential length L of the outlet port. Over the circumferential part of the rotor where the slots do not extend the gas flow to the associated nozzles in cut off. The resulting deflection pattern of metal spray is as shown in FIG. 9A. The two outlet ports 40 are axially aligned with each other and the valve apertures in the rotor are symmetrical about their circumferential mid-length positions D.

Figure 10:
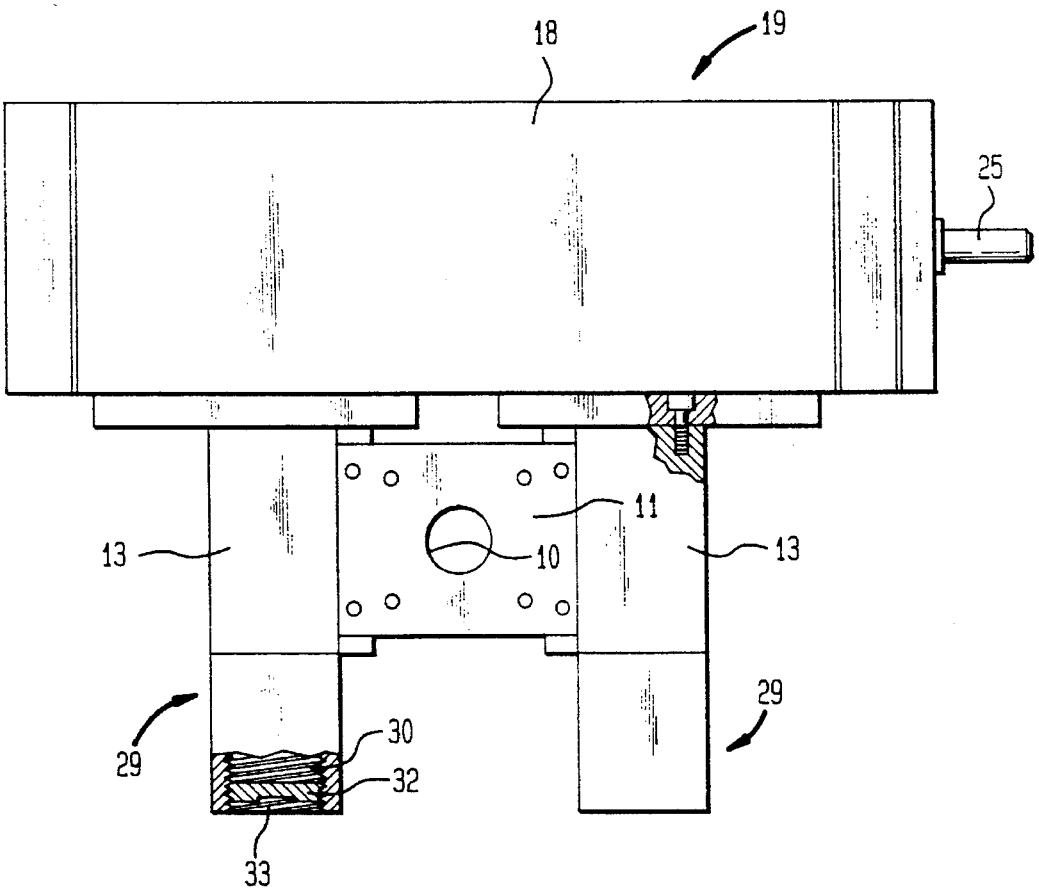
FIG. 10 is a plan view of a modification of the apparatuses of FIGS. 1 to 5 and 7 to 9.

Improved evenness can be obtained using the modification illustrated in plan in FIG. 10. The modification comprises the addition at the forward end of each nozzle block of a reservoir 29 which communicates with the manifold passage 16. Each of the two reservoirs is in the form of a hollow metal cylinder 30, the end wall of which is adjacent the nozzle block and the end wall of the nozzle block being drilled through to form the communicating passage. The outer end wall of the reservoir is formed by a thick plate 32 the outer edge of which is in screw-threaded engagement with the circumferential wall of the cylinder. A square recess 33 is formed in the outer face of the plate to receive a tool enabling the plate 32 to be screwed inward or outward relative to the circumferential wall of the cylinder to reduce or increase the effective volume of the reservoir. The provision of the reservoir has a substantial smoothing effect on the changes in the volume of air delivered to the nozzles corresponding to changes in the dimensions of the grooves 26 in the rotor. By continuously monitoring the variation in thickness of the coating of sprayed metal across the width of the workpiece, the position of the plate 32 can be adjusted to provide the reservoir volume giving the most even distribution of the sprayed metal.

It will be understood that although only two sets of nozzles 14 and two respective supply channels for gas for the nozzles are shown, additional nozzles or sets of nozzles may be provided, each having a controlled supply channel provided by the rotary valve.

In one arrangement, the outlet ports in the stator are choked, the gas flowing through it at sonic speed. In this arrangement, an increase in the supply pressure of the gas results in an increase in the mass of gas supplied to the nozzles without increasing the velocity of the gas.

We claim:

1. Metal spraying apparatus comprising means for producing a stream of molten metal particles, a plurality of sets of gas nozzles arranged to direct a flow of gas at said molten metal particle stream in a direction inclined at an acute angle to the axis of said stream to deflect the flow laterally, and rotary valve means for controlling cyclically the timing and quantity of gas supplied to the plurality of sets of gas nozzles to cause the molten metal particle stream to move cyclically to and fro laterally, said rotary valve means comprising a stator and a rotor and having respective flow passages comprising slots or grooves, said plurality of sets of gas nozzles including two sets disposed at diametrically opposite sides respectively of the axis of the molten metal particle stream, and said rotary valve means being arranged to supply gas to the two sets of nozzles through said respective flow passages, wherein the effective cross-sectional area of each of said passages varies in a predetermined manner between a minimum and a maximum over a substantial proportion of a cycle of movement of said molten metal particle stream, the predetermined manner of variation of said cross-sectional area being dependent on a variation in the shape and configuration of respective parts of said respective slots or grooves.

2. Apparatus as claimed in claim 1, wherein said effective cross-sectional area of each of the flow passages in turn increases from said minimum to said maximum and decreases back to said minimum, the said area of each flow passage commencing to increase after the said area of the other flow passage has decreased to said minimum.

3. Apparatus as claimed in claim 1 or claim 2, wherein the rotor comprises a cylindrical rotor mounted for rotation in a cylindrical bore in the stator, the flow passages of the rotor for each set of nozzles comprising a circumferentially extending groove the radial cross-sectional area of a part of which varies in said predetermined manner, and the stator having inlet ports connected to be supplied with gas and outlet ports circumferentially aligned with the inlet ports respectively, the inlet and the respective aligned outlet ports being aligned with the respective grooves in said rotor whereby gas flows from each inlet port to the associated outlet port by way of one of the circumferentially extending grooves in the rotor.

4. Apparatus as claimed in claim 3, wherein the cross-sectional area of said circumferentially extending groove varies stepwise.

5. Apparatus as claimed in claim 1, wherein the rotor comprises a hollow cylinder rotor mounted for rotation in a cylindrical bore in the stator, the interior of the rotor being connected to be supplied with gas, each of the flow passages of the rotor for each set of nozzles is a circumferentially extending slot, and the cross-sectional area of a part of the slot varies in said predetermined manner along its circumferential length in accordance with a variation of a respective axial width of said slot, the stator having for each set of nozzles an outlet port communicating with the set of nozzles and being axially aligned with the slot associated with the same set of nozzles, each outlet port having a cross-sectional area equal to or greater than a cross-sectional area of a part of the slot having the greatest cross-sectional area.

6. Apparatus as claimed in claim 5, wherein the circumferentially extending slot has a uniform depth and the axial width varies in a predetermined manner along its circumferential length, and wherein the associated port in the stator registers with the slot and has a predetermined circumferential length and an axial width equal to or greater than the maximum axial width of the slot, whereby the cross-sectional area of a part of the slot that is in register with the port defines the effective flow area through the port which is given by the circumferential length of the port multiplied by the axial width of the slot which is instantaneously in register with the port.

7. Apparatus as claimed in claim 5, wherein the axial width of said slot varies stepwise.

8. Metal spraying apparatus comprising means for producing a stream of molten metal particles, a plurality of sets of gas nozzles arranged to direct a flow of gas at said molten metal particle stream in a direction inclined at an acute angle to the axis of said stream to deflect the flow laterally, and valve means for controlling cyclically the timing and quantity of gas supplied to the sets of gas nozzles to cause the molten metal particle stream to move cyclically to and fro laterally, said sets of gas nozzles including two sets disposed at diametrically opposite sides respectively of the axis of the molten metal particle stream, characterized in that the valve means supplies gas to the two sets of nozzles through respective flow passages the effective cross-sectional area of each of which varies stepwise between a minimum and a maximum in a series of predetermined incremental steps.

* * * * *